United States Patent [19]

Barnes et al.

[11] 4,051,774

[45] Oct. 4, 1977

[54] MACHINE FOR PRINTING MEASURING TAPES

[75] Inventors: Carl Kenneth Barnes; John Owen Barnes, both of Suffield, Conn.

[73] Assignee: Jack Barnes Engineering, Inc., Enfield, Conn.

[21] Appl. No.: 687,107

[22] Filed: May 17, 1976

[51] Int. Cl.[2] ..... B41F 17/10

[52] U.S. Cl. ..... 101/37; 101/74; 101/218; 101/219

[58] Field of Search ..... 101/36, 37, 35, 73, 101/74, 75, 212, 216, 217, 218, 219, 247

[56] References Cited

U.S. PATENT DOCUMENTS

| | | | |
|---|---|---|---|
| 1,100,284 | 6/1914 | Bohnengel | 101/74 |
| 2,036,835 | 4/1936 | Sites | 101/217 X |
| 2,066,179 | 12/1936 | Keller | 101/219 |
| 2,515,854 | 7/1950 | Bodkin | 101/44 |
| 2,972,297 | 2/1961 | Auerbacher | 101/181 |
| 3,131,631 | 5/1964 | Haskins, Jr. | 101/247 X |
| 3,143,062 | 8/1964 | Rankin et al. | 101/74 |
| 3,162,117 | 12/1964 | Young | 101/74 X |
| 3,329,088 | 7/1967 | Rockefeller, Jr. | 101/212 X |
| 3,552,308 | 1/1971 | Minehart | 101/37 |
| 3,711,757 | 1/1973 | Reforzo | 101/37 X |
| 3,921,518 | 11/1975 | Carnes, Jr. | 101/111 |

OTHER PUBLICATIONS

Dayger; J. E., "Printer"; IBM Technical Disclosure Bulletin, vol. 10, No. 3, Aug. 1967, p. 299.

Kearney, et al., "Endless Carrier Printers"; Western Electric Technical Digest No. 28 (Oct. 1972), p. 23.

*Primary Examiner*—Clifford D. Crowder

*Attorney, Agent, or Firm*—Ross, Ross & Flavin

[57] ABSTRACT

A machine for printing steel tapes of long length comprising a first printing station for printing inch graduations thereon in a first color, a second printing station for printing foot graduations and other data thereon in a second color, and an automatic digital control unit for controlling the pressure-exerted on the tape by an impression wheel to effectively control the spacing of the graduations.

1 Claim, 18 Drawing Figures

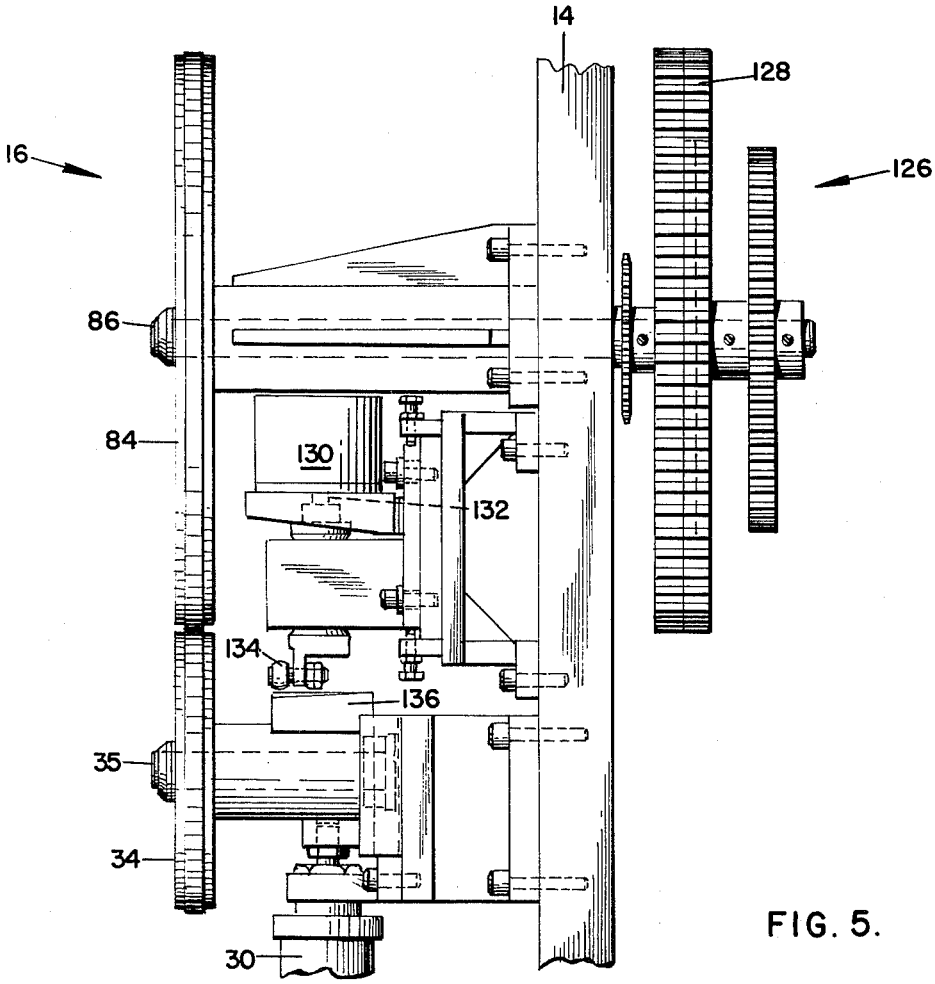
FIG. 5.
FIG. 6.
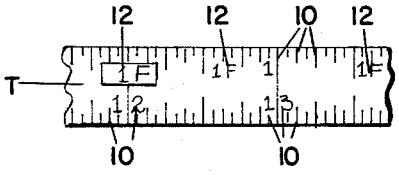
FIG. 7.
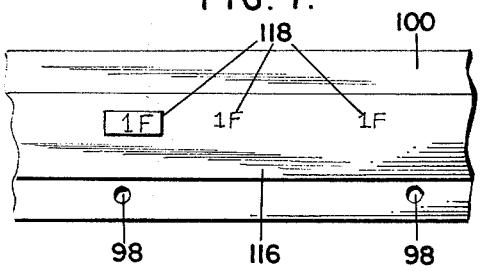
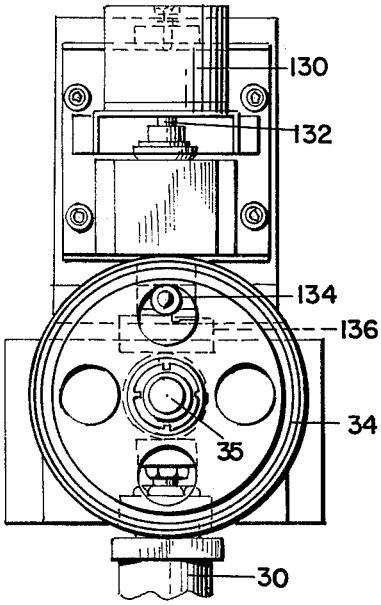
FIG. 8.

MACHINE FOR PRINTING MEASURING TAPES

Our invention relates to a machine for printing in two colors graduated, flexible steel measuring tapes of 50 or 100 foot lengths.

A primary object of the invention is to control the length of a tape without the use of tension on the tape.

Herein, we vary impression roll pressure to obtain variance in length. If the tape is printing too short, less pressure is exerted by the impression roll on the blanket roll to give a larger diameter to that roll. If the tape is printing too long, more pressure is exerted by the impression roll on the blanket roll to give a smaller diameter to that roll.

In the machine hereof, variance of impression roll pressure is effected based on signals delivered from an automatic digital control unit which receives its intelligence from encoder and fiber optic control units disposed at spaced intervals along the linearly travelling tape blank.

Impression roll pressure is varied by precision cams associated therewith and automatically controlled by the digital control unit.

Tapes of 50 and 100 foot lengths of extreme accuracy can be produced, the inch graduations being printed in one color, for example black, and the foot graduations being printed in a second color, for example red.

In the drawings:

FIG. 5 is an enlarged fragmentary end elevational view of a portion of the first printing station thereof;

FIG. 6 is a fragmentary view of a steel tape of the type printed by the machine of the invention;

FIG. 7 is a top plan view of the perforated printing band for printing foot designations and other desired indicia on the tape, preferably in a second color; and FIG. 8 is an enlarged front elevational view of the stepper motor and precision cam roll assembly for varying pressure on the tape.

Referring first to FIG. 6, we have shown a section of steel measuring tape T, of the type printed by the machine of the invention, carrying inch graduations 10, preferably printed in black ink, and foot graduations 12, preferably printed in red ink. Other indicia such as stud markings, tradenames and the like, not shown, may also be printed.

Figure 1:
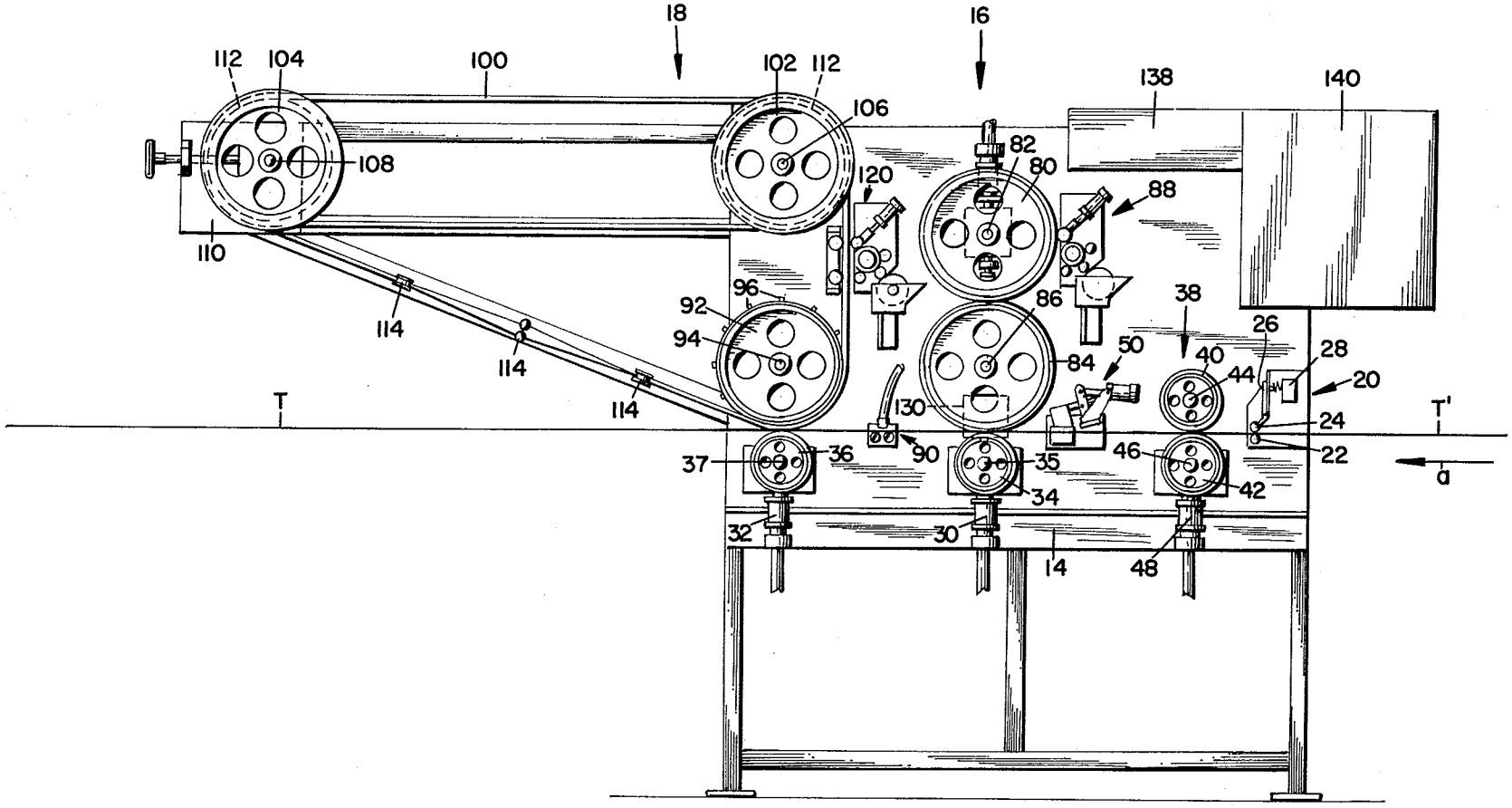
FIG. 1 is a front elevational view of a tape printing machine embodying the invention.

The printing machine hereof is mounted on a supporting framework 14 and includes a first printing station, generally indicated by 16, at which the first color black is imprinted on a tape blank T', and a second printing station, generally indicated by 18, at which the second color red is imprinted thereon, the tape blank moving linearly through the machine in the direction indicated by arrow *a* in FIG. 1, being fed from a supply reel or the like, not shown, disposed at one end of the machine or to the right as seen in FIG. 1.

The tape blank initially passes through a detecting unit 20 for detecting irregularities such as welds or the like in the blank which could cause damage to the machine. When such irregularities are encountered by the detecting unit, the rolls of the printing stations are opened until the offending portion has cleared the second printing station, at which time the rolls are returned to a closed position.

The detecting unit comprises a fixed roll 22 disposed below the tape and a movable roll 24 carried by an arm 26 pivotally mounted above the tape and adapted to contact a limit switch 28. Any irregularity in the tape causes arm 26 to pivot whereupon switch 28 is activated.

Activation of switch 28 signals a pair of air cylinders 30 and 32, associated with the first and second printing stations respectively, to open.

Opening of the cylinders 30 and 32 causes a first impression roll 34 fixed to a shaft 35 journalled in framework 14 below the tape at the first printing station to move downwardly to an opened position, along with a second impression roll 36 fixed to a shaft 37 journalled in framework 14 below the tape at the second printing station. The impression rolls remain in this opened position for a predetermined time period sufficient for the irregularity on the tape to clear the machine, following which the limit switch 28 is deactivated and the impression rolls returned by the air cylinders to their normal closed positions.

A feed assembly 38 is disposed immediately adjacent detecting unit 20 and comprises a pair of vertically aligned upper and lower rolls 40 and 42 respectively one bearing on each face of the tape blank for pulling the blank from the supply reel.

Upper roll 40 is fixed to a shaft 44 journalled in framework 14 above the tape blank and lower roll 42 is fixed to a shaft 46 journalled in the framework below the tape blank and adapted for vertical adjustment by means of an air cylinder 48 associated therewith, whereby the pressure of the rolls exerted on the tape blank may be selectively varied.

Figure 3:
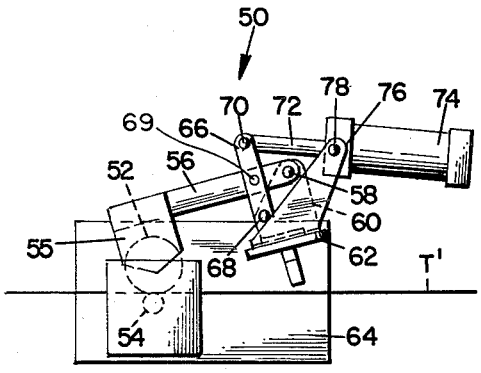
FIG. 3 is an enlarged front elevational view of the encoder unit thereof.
Figure 4:
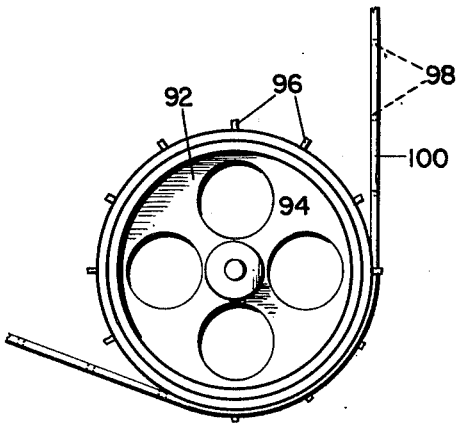
FIG. 4 is an enlarged front elevational view of the pin roll thereof.

An encoder unit 50, best seen in FIG. 3, is disposed between feed assembly 38 and first printing station 16 for monitoring the length of tape being fed through the machine.

The encoder unit includes vertically aligned upper and lower rolls 52 and 54 respectively disposed on each side of the tape.

Upper roll 52 is vertically adjustable by means of a system of links which includes a support link 55 to which the roll is pivoted, the support link depending from one end of a first connecting link 56 which is pivoted at its opposite end at 58 to a pivot plate 60 mounted on a support plate 62 extending outwardly from a mounting plate 64 on framework 14. A second connecting link 66 is pivoted at its lower end at 68 to pivot plate 60, at its approximate midsection at 69 to first connecting link 56 and at its upper end at 70 to the piston rod 72 of an air cylinder 74 supported by a bifurcated plate 76 extending between the air cylinder and support plate 62, the plate 76 being fixed to the support plate and pivotally connected to air cylinder 74 as by pivot pins 78. One revolution of the lower roll 54 is equal to one linear inch of travel of the tape, as will appear.

First printing station 16 includes, in addition to first impression roll 34, a master print roll 80 fixed to a shaft 82 journalled in framework 14 and a blanket roll 84 fixed to a shaft 86 also journalled in the framework. Master print roll 80 and blanket roll 84 are in running engagement with each other and the blanket roll is in running engagement with the tape blank T' therebelow, the shaft 82 and 86 also being vertically aligned with shafts 35 of impression roll 34 disposed below the tape blank.

A first color inker 88 of conventional make, is in running engagement with master print roll 80 and applies the first color ink to a printing die not shown, carried on its periphery. The printing die, in the form of inch graduations, reproduces impressions of the graduations onto the periphery of the blanket roll and these impressions are, in turn, transferred onto the upper surface of the tape blank T' disposed therebelow, the tape being supported by impression roll 34.

The tape, with the inch graduations 10 imprinted thereon in black ink moves from the first printing station to the second printing station, passing through a fiber optic control unit 90 which operates in conjunction with encoder unit 50, in manner to be explained.

Second printing station 18 includes a pin roll 92 fixed to a shaft 94 journalled in framework 14 above the tape and vertically aligned with shaft 37 of impression roll 36.

Pin roll 92 carries a plurality of equi-spaced radially-arranged outwardly-extending pins 96 on its periphery, which pins are engageable in equi-spaced openings 98 in a flexible printing band 100 entrained around the pin roll and around a pair of spaced first and second grooved rolls 102 and 104 respectively disposed above the pin roll.

First grooved roll 102 is fixed to a shaft 106 journalled in framework 14 and vertically aligned with pin roll shaft 94 and impression roll shaft 37.

Second grooved roll 104 is fixed to a shaft 108 journalled in an auxiliary framework 110 which extends outwardly from framework 14, shaft 108 being horizontally spaced from and aligned with first grooved roll shaft 106.

Figure 2:
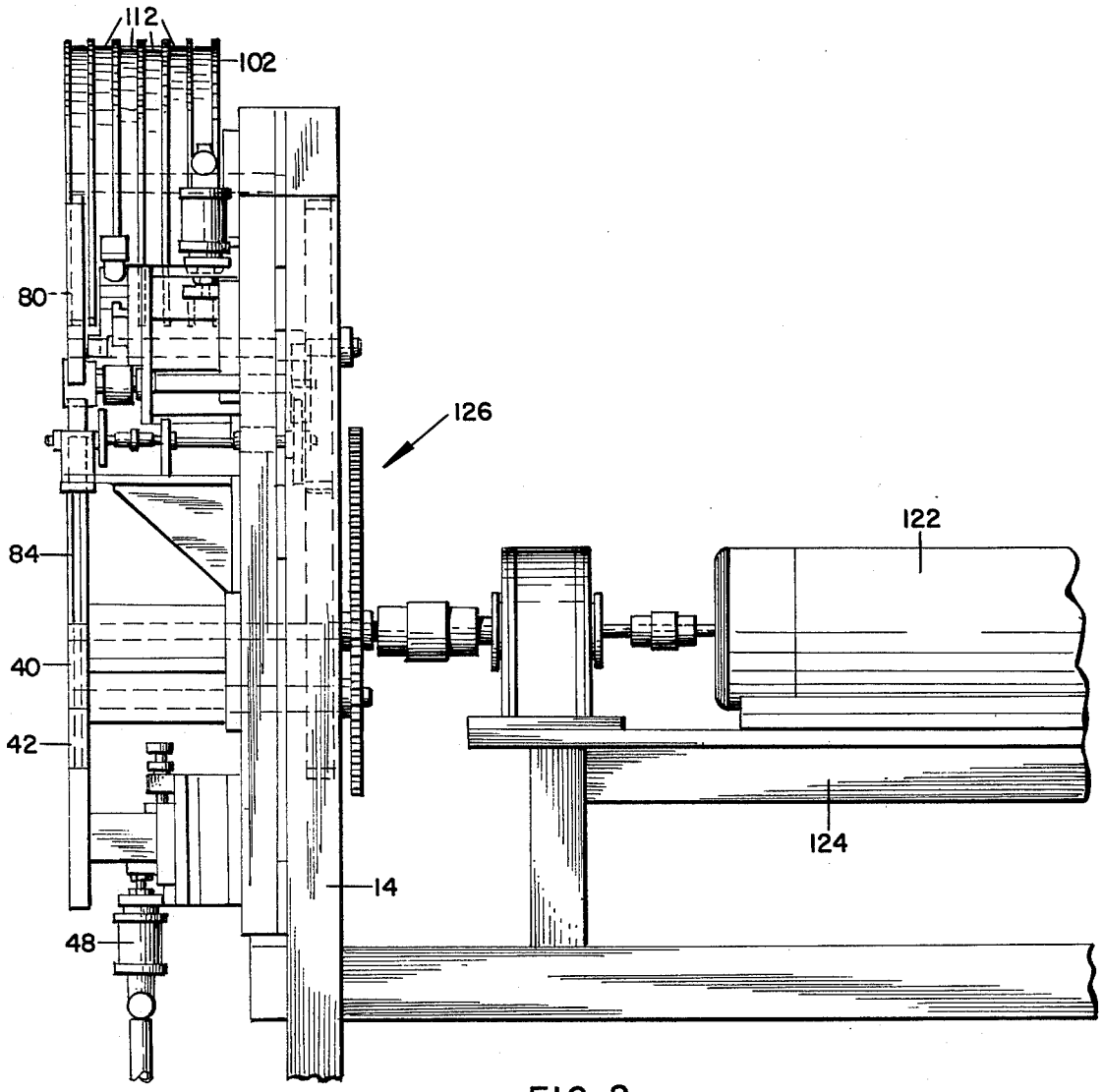
FIG. 2 is a fragmentary end elevational view thereof as seen from the right of FIG. 1, with parts omitted for purposes of clarity.

As best seen in FIG. 2, the grooved rolls are each provided with side-by-side peripheral grooves 112 in which the printing band 100 is receivable.

The printing band is helically turned at turning rollers 114 on auxiliary framework 110 and then passes back and forth from one grooved roll to the other. In this manner a 100 foot band can be accommodated in a relatively small space.

As best seen in FIG. 7, printing band 100 carries a rubber printing die 116 having characters 118 thereon for printing the foot graduations 12 either of 50 foot length or 100 foot length.

Printing die 116 receives ink from a second color inker 120 disposed on framework 14 between first grooved roll 102 and pin roll 92 and this data is transferred to the tape blank T' at impression wheel 36 in the form of the foot graduations 12 printed in red ink.

The completed tape T is drawn from the printing machine for further processing at such as a dryer unit or the like, not shown.

The entire machine is driven by a motor 122 disposed on a platform 124 supported rearwardly of framework 14, the motor driving a plurality of meshing gears generally indicated by 126 fixed to the shafts of the impression rolls 34, 36 and 42, the master print roll 80, blanket roll 84 and pin roll 92 in known manner. The color inkers 88 and 120 are chain driven.

As seen in FIG. 5, a spring-loaded split ring-type gear 128 may be disposed on blanket roll shaft 86 to preclude back lash.

Referring to FIGS. 5 and 8, a stepper motor 130 is supported on framework 14 rearwardly of blanket roll 84, the motor drive shaft 132 carrying a precision cam roll 134 on its lower end, the cam roll being rideable along and relative to a precision rise and fall cam 136 associated with shaft 35 of first impression roll 34.

Rotation of the stepper motor in clockwise fashion causes the cam roll to move to the right along rise and fall cam 136 as viewed in FIG. 8, while counterclockwise rotation of the stepper motor causes the cam roll to move to the left, thereby varying the pressure on first impression roll shaft 35 to vary the pressure exerted by the impression roll on the tape blank T'.

Signals to the stepper motor are received from an automatic digital control unit 138 based on data reported thereto by encoder unit 50 and fiber optic control unit 90.

The fiber optic control unit 90 picks up four spots, namely, four spots located at the inch graduations printed on the tape by the blanket roll 84 and relays this information to counters in the digital control unit 138. This information is equalized with information relayed from encoder unit 50, one revolution of the roll 54 of which is equal to one linear inch. This information is then fed to stepper motor 130 in the form of signals telling the motor whether the tape is printing long or short and instructing the motor to rotate in a clockwise or counterclockwise direction.

An operator's control panel 140 containing the usual control gauges and switches not shown, is disposed adjacent control unit 138.

We claim:

1. A machine for printing long flexible measuring tapes comprising:

a first printing station for printing inch graduations on a tape blank in one color, a second printing station for printing foot graduations and other indicia on the tape blank in a second color, means for moving the tape blank linearly through the printing stations, the first printing station comprising a master print roll, a blanket roll and an impression roll, the master print roll and blanket roll being in running engagement with each other and the blanket roll being in running engagement with the upper planar surface of the tape blank, the impression roll being in running engagement with the lower planar surface of the tape blank and underlying the blanket roll, the second printing station comprising a perforated printing band entrained about a pin roll and about a pair of grooved rolls, the printing band having printing dies on one surface thereof in running engagement with the tape blank, and passing back and forth between the grooves of the grooved rolls, means for varying the pressure of the impression roll on the tape blank for controlling the spacing of the graduations printed on the tape by the blanket roll comprising a precision cam roll selectively rideable in clockwise and counter clockwise direction relative to a cam surface on the impression roll shaft, and wherein movement of the cam roll is controlled by a digital control unit based on information fed to said unit from an encoder wheel and a fiber optic control unit linearly spaced along the line of travel of the tape blank before and after the first printing station respectively for sensing and reporting graduation spacing, wherein one rotation of the encoder wheel is equal to one inch of linear travel of the tape blank, with each such rotation of the encoder wheel being reported to the digital control unit, and wherein the fiber optic control unit senses indicia printed at spaced intervals along the tape blank and reports to the digital control unit, which directs appropriate movement of the cam roll.

* * * * *